US007316597B2

(12) United States Patent
Skedeleski

(10) Patent No.: US 7,316,597 B2
(45) Date of Patent: Jan. 8, 2008

(54) TRACTION PAD FOR PERSONAL WATER BOARD

(75) Inventor: David Skedeleski, Pearl City, HI (US)

(73) Assignee: Surfco Hawaii, Pearl City, HI (US)

( * ) Notice: Subject to any disclaimer, the term of this patent is extended or adjusted under 35 U.S.C. 154(b) by 0 days.

(21) Appl. No.: 11/470,740

(22) Filed: Sep. 7, 2006

(65) Prior Publication Data

US 2007/0054573 A1 Mar. 8, 2007

Related U.S. Application Data

(60) Provisional application No. 60/714,335, filed on Sep. 7, 2005.

(51) Int. Cl.
*B63B 1/00* (2006.01)

(52) U.S. Cl. ..... 441/65; 441/74

(58) Field of Classification Search ..... 441/65, 441/74; 238/14; 114/357
See application file for complete search history.

(56) References Cited

U.S. PATENT DOCUMENTS 1,815,435 A * 7/1931 Harding et al. ..... 238/14
2,479,760 A * 8/1949 Merrick ..... 238/14
4,223,835 A * 9/1980 Witt et al. ..... 238/14
4,285,082 A 8/1981 Cox
4,871,337 A 10/1989 Harris
4,902,256 A 2/1990 Berglund
5,308,271 A * 5/1994 Foulke ..... 441/74
5,435,765 A 7/1995 Fletcher
5,460,558 A 10/1995 Woodstock
5,499,836 A 3/1996 Juhasz
5,529,523 A 6/1996 Wilhelmi
5,625,964 A 5/1997 Lyden et al.
5,638,612 A 6/1997 Douzis
5,679,039 A 10/1997 Robles
5,704,137 A 1/1998 Dean et al.
5,756,204 A 5/1998 Ellman
5,766,051 A 6/1998 Messer
5,910,035 A 6/1999 Rebotier
5,930,918 A 8/1999 Healy et al.
5,947,781 A 9/1999 VonWald et al.
5,987,780 A 11/1999 Lyden et al.
6,007,394 A * 12/1999 Kagan ..... 441/74

(Continued)

FOREIGN PATENT DOCUMENTS

DE 100 40 775 A1 3/2002

*Primary Examiner*—Lars A. Olson
(74) *Attorney, Agent, or Firm*—Nixon & Vanderhye P.C.

(57) ABSTRACT

A traction surface for a water board has been developed comprising: a traction pad formed of a molded clear thermo plastic elastomer (TPE) material, and an upper surface of the pad having a roughened texture. The upper surface of the pad may include a center ridge extending a length of the pad and substantially parallel to a centerline of the board. Further, the upper surface may include a back step at a rear of the pad and a plurality of interlaced ribs and grooves extending substantially parallel to a centerline of the board. The grooves may be spaced apart at substantially the spacing of the toes of a foot of an adult male. In addition, the pad may include a bottom surface having a lip extending around a perimeter of the bottom surface. Moreover, injection molding may form the pad.

24 Claims, 6 Drawing Sheets

U.S. PATENT DOCUMENTS 6,082,025 A 7/2000 Bonk et al.
6,158,149 A 12/2000 Rudy
6,258,421 B1 7/2001 Potter
6,702,273 B1 * 3/2004 Sellers ..... 269/289 R
6,767,264 B2 7/2004 Mercer
2003/0124923 A1 7/2003 Mercer

* cited by examiner

TRACTION PAD FOR PERSONAL WATER BOARD

BACKGROUND OF THE INVENTION

This application claims the benefit of U.S. Provisional Patent Application Ser. No. 60/714,335 filed Sep. 7, 2005, which application is incorporated by reference and in its entirety.

This invention relates to personal water boards, such surfboards, boat deck surfaces, jet ski decks and saddles. In particular, the invention relates to a means for providing traction between the board and the feet of the rider. The invention may also have application to other water exposed surfaces which support the feet, hands, bottom or chest of a person.

Surfboards require some type of wax or traction surface to prevent the feet of a surfer from slipping off the board while in the water. Traditional methods of creating a non-slip surface on a board have been to rub a paraffin type wax on a board or to apply a traction pad made of EVA foam sheets.

Often a surfer will apply a traction pad on the rear deck of a board and apply wax to the forward section of the upper surface of the board. An EVA foam traction pad provides a superior grip for the back foot allowing the surfer to steer or direct the forward movement of the board while surfing a wave. EVA foam traction pads are also applied to the forward section of the board where the front foot of the surfer is positioned. However, the rough surface of EVA foam can irritate and cause a rash to the skin of the surfer when lying on the deck of the board.

Traditional water board traction pads are made of EVA foam sheets that have been embossed with various surface patterns and die cut into different shapes. The EVA foam sheets adhered to the surfboard with a peel and stick adhesive. Foam blocks are often glued between layers of foam sheets to create raised surfaces on the traction pads. The EVA foam traction pads create a grip for the feet of a surfer, but the rough foam surface causes abrasion to the skin when the surfer is lying on the deck of the board. Further, traditional EVA foam traction pads have a straight die cut perimeter edge that irritates the skin of the surfer and often peels up from the surface of the board.

EVA foam traction pads are opaque and typically solid in color, preventing the board or graphics on the board from being visible under the pad.

BRIEF DESCRIPTION OF THE INVENTION

A traction surface for a water board has been developed comprising: a traction pad formed of a molded clear or tinted thermo plastic elastomer (TPE) material, and an upper surface of the pad having a roughened texture. The TPE material allows the board and graphics under the traction to be visible through the pad. The molded TPE material is less abrasive than the EVA foam, reducing irritation to the skin of the surfer.

A traction surface has been developed for a water board comprising: a traction pad formed of a molded thermo plastic elastomer (TPE) material, and an upper surface of the pad having a roughened texture. The traction surface may include a center ridge extending a length of the pad and substantially parallel to a centerline of the board, a back step at a rear of the pad and a plurality of interlaced ribs, and grooves extending substantially parallel to a centerline of the board. The grooves may be spaced apart at substantially the spacing of the toes of a foot, such as of an adult male. The pad may be formed by injection molding. The pad may be applied to a water board, such as a surfboard, wake board, sail board and skim board. The pad may be translucent or transparent, e.g., clear or tinted.

The traction pad for a water board may comprise: an upper surface of the pad having a roughened texture, an underside including ridges and chambers between the ridges, wherein the chambers have an open side to be closed by a surface of the water board, and the traction pad is formed of a molded thermo plastic elastomer (TPE) material. The traction pad may further comprise an adhesive on the underside and a release liner on the adhesive.

A method has been developed to make and apply a traction pad to a water board comprising: injection molding a thermo plastic elastomer (TPE) material to form an upper surface of the pad having a roughened texture and an underside including ridges and chambers between the ridges an upper surface of the pad having a roughened texture; applying an adhesive material to the underside of the pad and coating the adhesive with a release liner; preparing the board to receive the pad by cleaning the board; removing the release liner from the pad to expose the adhesive, and applying the exposed adhesive and pad to the board. The method may include aligning the pad with a longitudinal centerline of the board. The adhesive material may be applied to a flat border on the underside of the board and to the ridges on the underside of the board. The method apply a transparent or translucent pad to allow viewing of patterns on the board below the pad.

DETAILED DESCRIPTION OF THE INVENTION

Figure 1:
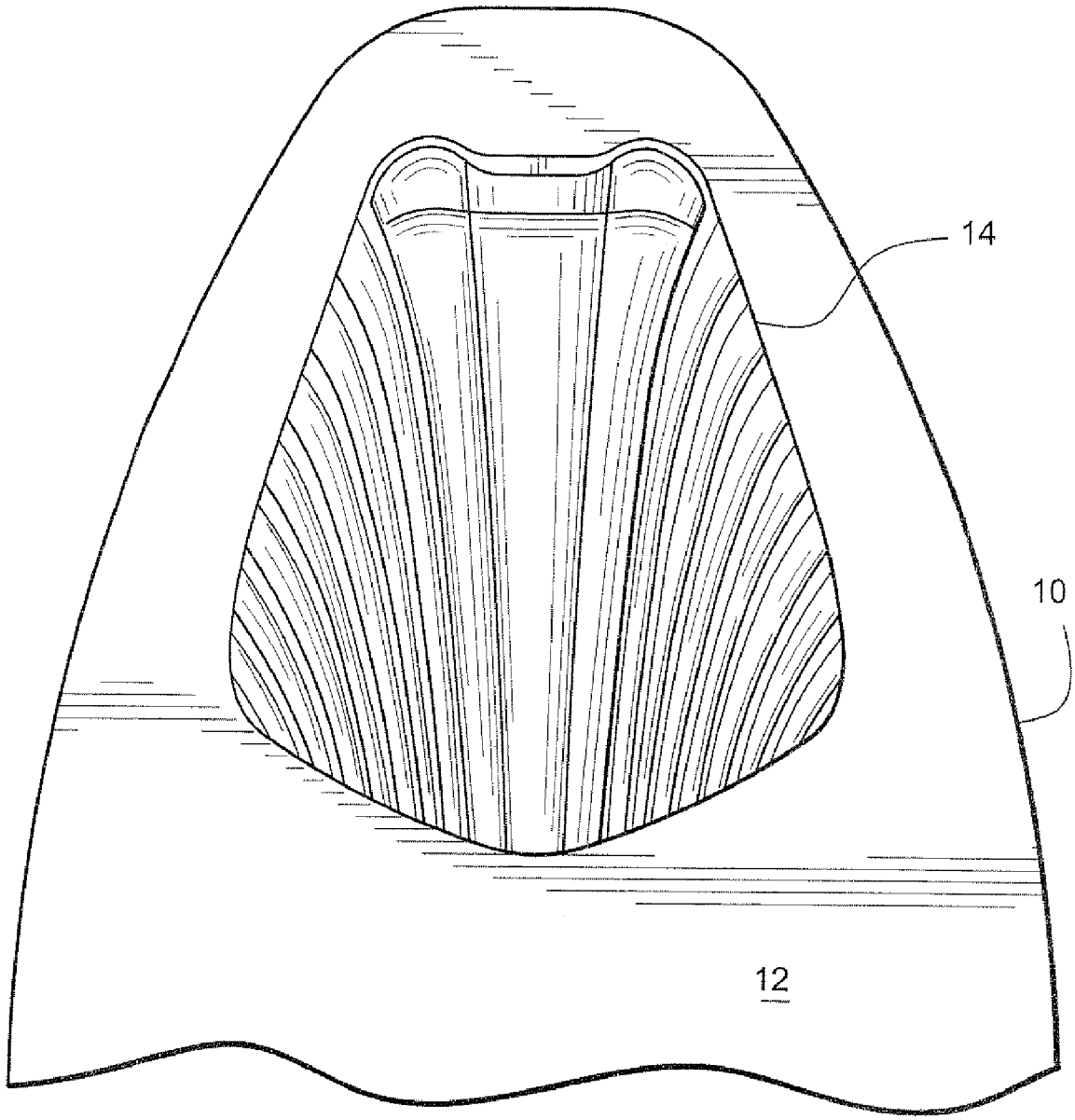
FIG. 1 is a perspective view of a traction pad for a water sport board on a surfboard.

FIG. 1 shows a water board 10 having an upper surface 12. The water board may be a surfboard, wake board, skin board, sail board, skim board and other personal boards that support riders on water. The traction pad 14 may also be at or forward of the longitudinal center point of the upper surface and provide a rest for the chest of a prone surfer or the forward foot of a surfer. The traction pad may also be on the foot rest and saddle of a jet ski boat, or on the floor of a boat were boaters typically stand, such as for fishing or steering.

As shown in FIGS. 1 to 6, the upper surface of the pad may include a center ridge 16 extending a length of the pad and substantially parallel to a centerline of the board. Further, the upper surface may include a back step 18 at a rear of the pad and a plurality of interlaced ribs 20 and grooves extending substantially parallel to a centerline of the board. The traction surface is ergonomically designed so the foot of the surfer fits comfortably on the pad.

A forward pad may also be applied to the upper surface of the board to allow the front foot to comfortably stand on the board. A forward pad formed of TPE is also comfortable and not irritating to the chest or upper torso of a prone surfer on the board.

A pad of TPE material may be injected molded. A mold is formed having a cavity in the shape of the pad. The interior of the cavity may have a textured upper surface to apply a texture to the upper surface of the pad. The upper surface of the cavity may have ribs to form the longitudinal ribs on the upper surface of the pad. The lower surface of the cavity may includes ridges to form ridges in the underside of the pad. The ridges on the underside of the pad provide structural support and define air chambers between the pad and the upper surface of the board.

There may be dozens of mini air chambers 44 defined between the ridges in the underside of the pad. The air chambers are deformable and allow the traction to conform to the surfers' foot. The air chambers also create a cushioning of the foot and torso of the surfer. The air chambers are formed between the supporting ridges that extend from the bottom of the pad to the board surface. The ridges are generally aligned with the surface features on top of the pad, but may include ridges that are transverse to the surface features.

The air chamber technology also reduces the weight and creates a distinctive appearance of the traction pad. The air chambers are designed with structural support ribs that prevent the air chambers from collapsing under the weight of the surfers' feet. The bottom of the support ribs also provides surface area for the peel and stick adhesive.

Because the pads are injection molded, a variety of materials may be used to create a variety of textures. The range can be from a "gel" texture using a 10-20A durometer to a "firm" using a 60-80A durometer materials. The perimeter edges of the traction pad are designed to be smooth and beveled reducing irritation to the skin of the surfer. Application of the traction pad to the surfboard may be with a peel and stick adhesive.

On the upper surface of the board, the feet of a rider are typically positioned on the upper surface along a centerline of the board and typically towards the center and rear of the board. The traction pad 14 is attached to the upper deck of the board where the rider typically positions his feet. The traction pad may be a single pad or an array of two or more pads arranged on the upper deck where the feet are normally positioned.

The traction pad 14 may be generally trapezoidal in plan view and have a thickness of less than an inch to a few inches. The traction pad may be designed to provide a footpad for a board rider. The surface texture of the traction pad may be sufficiently knurled, dimpled, coarse or otherwise roughened (collectively referred to as a roughened texture). The surface texture of the pad may be selected to provide a good grip for the feet of the board rider. Further, the surface texture may be selected to avoid abrading, irritating or otherwise harming the skin of the rider.

The traction pad comprises an upper surface 42 that may include one or more, e.g., three, center ribs 16 extending from the rear of the pad and along the centerline of the pad. The center ridge may extend the entire or only partially the length of the pad. The center ridge may provide an arch support for at least one foot, e.g., rear foot, of the rider. The rider positions the arch of his foot on one or more of the center ribs. When the pad is attached to the board, the center ridge of the pad may be aligned with the longitudinal axis of the board.

By feeling the ridge the rider can confirm that his foot is on the center line of the board. The arched ridge provides a good grip for the foot. The center ridge may be rounded with a crest parallel to the board centerline. The center ridge may be substantially parallel, e.g., within 10 degrees of parallel. The ridge may rise one half of an inch to a few inches (2.54 cm to several centimeters) from side edge to crest. The rider may use the ridge to feel the centerline of the board. Because the center ridge extends, for example, six inches to a few feet (18 cm to a meter), the rider can slide his foot up or back along the center ridge while riding the board.

Figure 2:
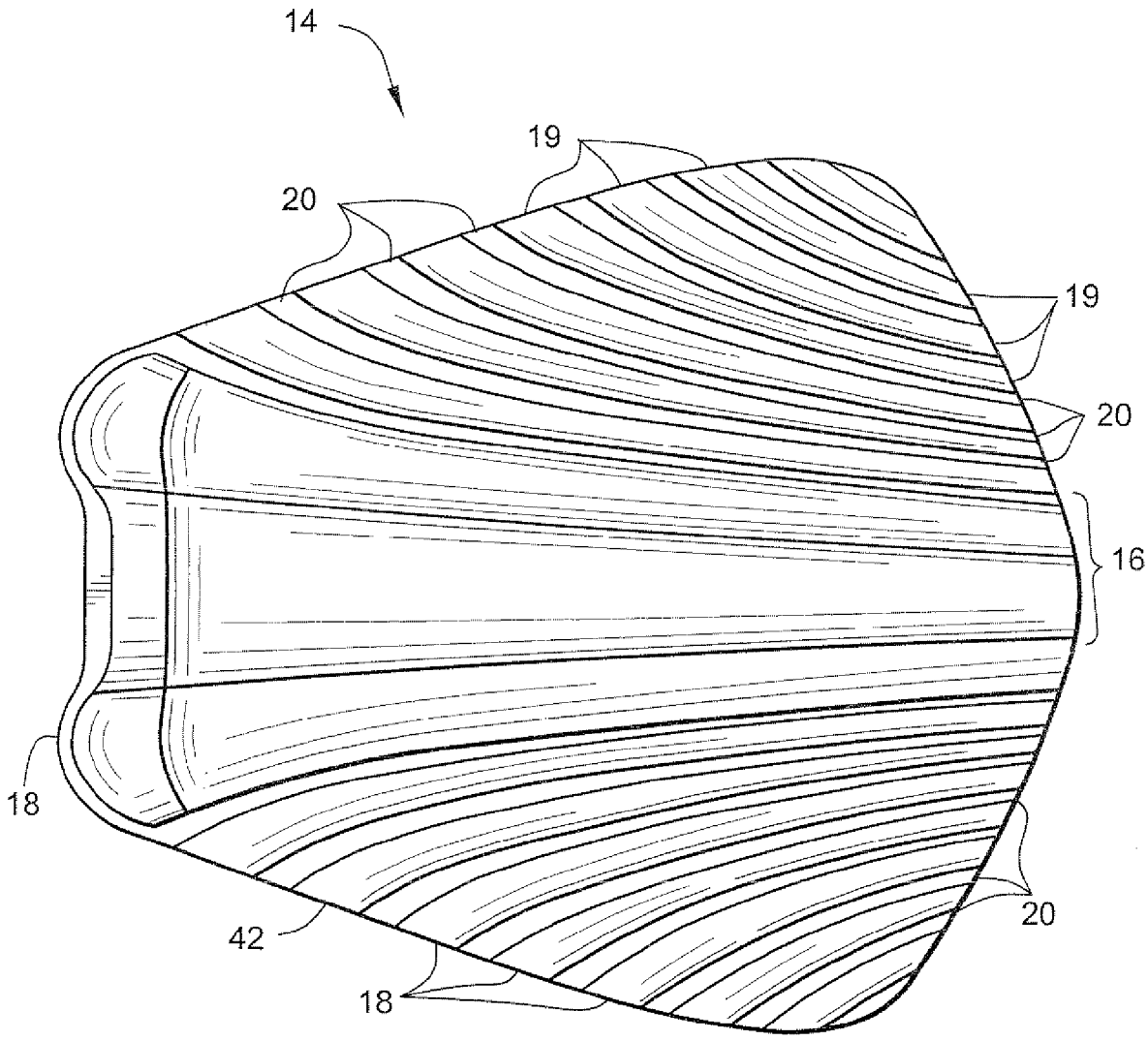
FIG. 2 is a top plan view of the traction pad.

FIG. 2 shows flow channels on the upper surface of the pad. The TPE injection molded traction pads are designed with "flow channels", e.g., grooves 19, that allow water that comes over the deck of the surfboard to be directed off the back of the pad. The traction pad may have several grooves 19 on both sides of the center ridge. The grooves provide passages for water to flow off the traction pad and may provide a grip for the toes of the feet of a rider.

The grooves 19 may be spaced apart at substantially the spacing of the toes of a foot of an adult male. For example, the spacing between grooves may approximately the same spacing between the toes of a rider. Between each groove may be ribs 20 that extend generally parallel to the center ridge, and may flair towards the rear of the pad. The ribs extend above the grooves. The inlet to the grooves 19 and ribs 20 may be along the front edges of the pad and the outlet of the grooves and ribs may be along the sides of the pad. The grooves may be also substantially parallel to the board centerline, e.g., within 10 degrees of parallel. The ribs 20 are generally straight and parallel to the center line of the board. Alternatively, the ribs may be wide towards the rear of the pad and narrow towards the front of the pad, and may gently curve from the rear to the front of the pad.

Figure 3:
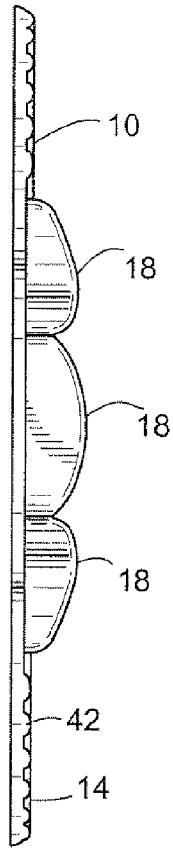
FIG. 3 is a rear view of the traction pad.

FIG. 3 shows an end view of the rear side of the pad 10 and particularly shows a back step 18 at the rear of the pad. The center ridge may expand widthwise towards where the ridge meets a back step 18 at the rear of the pad. The back step is generally perpendicular to the centerline of the board. The step may extend an inch to several inches, e.g., 2 to 4 inches (5 cm to 10 cm), above the board and one to two inches (2.45 cm to 5 cm) above the upper surface of the traction pad. The back step may have a generally rectangular cross-section or may have an arch cross section. The back step may comprise multiple projections, such as the three arch shaped projections shown in the figures. The back step provides a brace against which the rear foot of the rider may be positioned.

Figure 4:
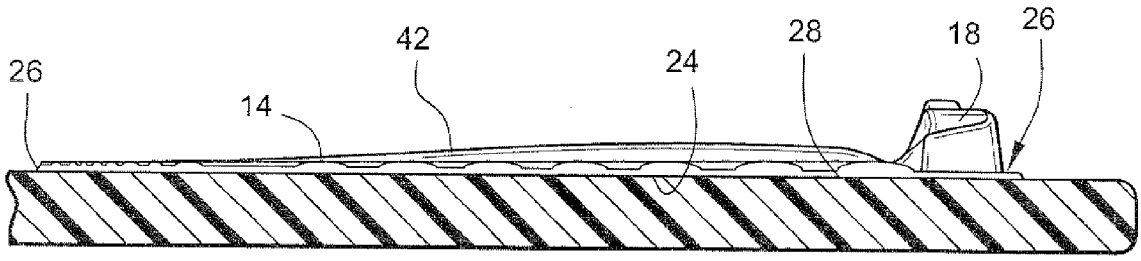
FIG. 4 is a left side view of the traction pad mounted on a surfboard.

FIG. 4 shows a cross-sectional side view of the board 10 and the pad. The backside 24 of the pad has a turned down edge 26 on the perimeter of the pad that creates a smooth transition of the edge of the traction to the upper deck 12 of the board. The ridge 26 also prevents the edges of the traction from peeling off the board surface. The ridge 26 may be a beveled lip on the perimeter of the pad that extends a short distance, e.g., ⅛ to ⅕ of an inch (3 mm to 5 mm). The edge of the pad may conform to the bottom surface of the board and forms a relatively water tight seal that protects the adhesive between the pad and board. A peel and stick adhesive 28 may be used to fix the traction pad to the board. The 3M Company of St. Paul, Minn., USA, offers suitable peel and stick adhesives to attach the pad to a surfboard.

Figure 5:
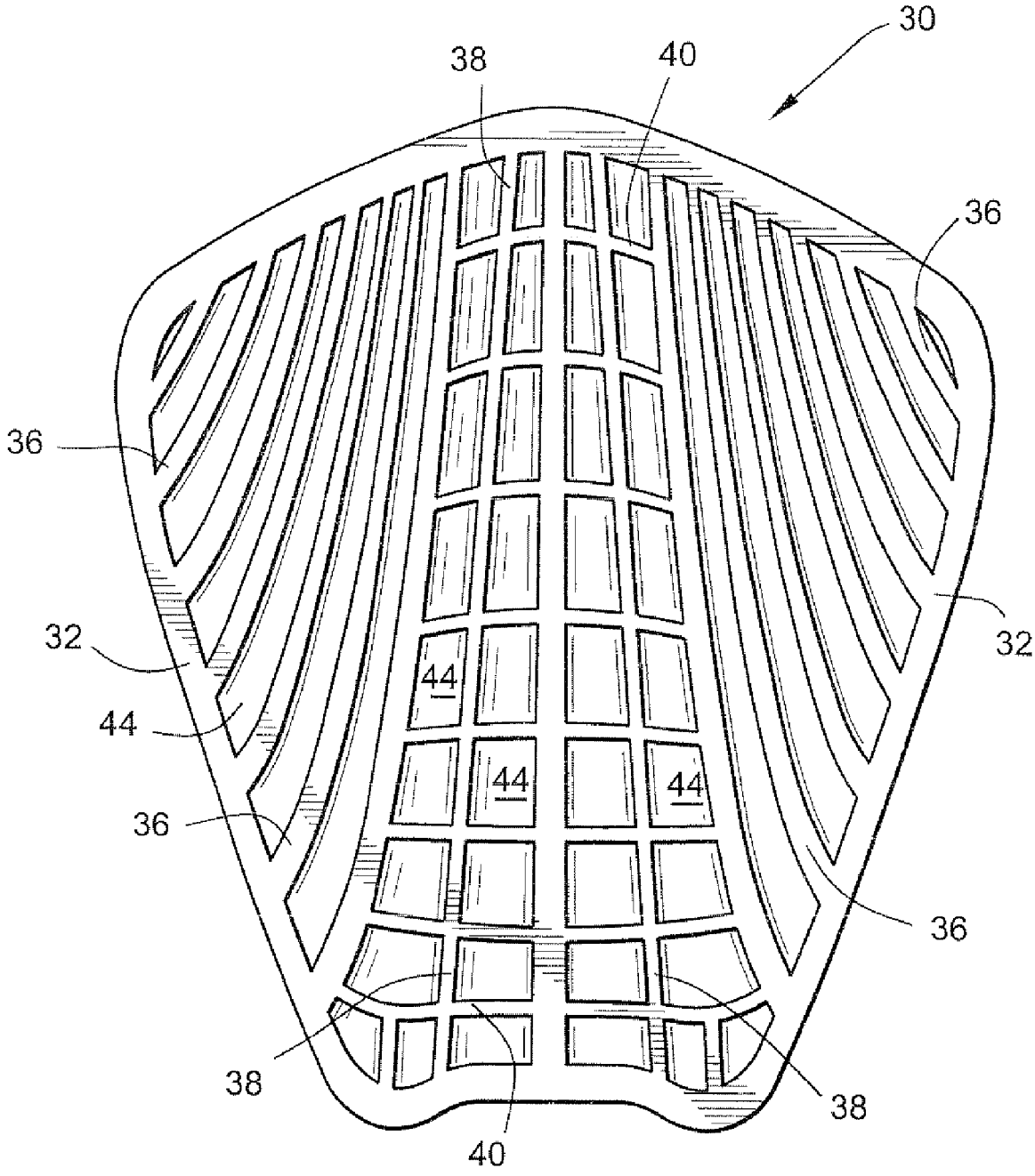
FIG. 5 is a bottom view of the traction pad showing the air chambers and support ribs.

FIG. 5 shows the underside surface 30 of the pad. The underside includes a flat border 32 at the perimeter 34 of the pad. The border is seated on the upper surface of the board and attaches to the upper surface. The seal between the border and the upper surface prevent seawater from seeping between the pad and the board. The underside surface 30 of the pad also includes a pattern of ridges 36 that generally conform to the grooves 19 on the upper surface of the pad. Additionally, ribs 38 extend longitudinally along the underside of the pad and conform generally to the center ribs 16 on the upper surface of the pads. The ridges 38 below the center ribs 16 may include longitudinal ridges 38 and transverse ridges 40. The ridges 36, 38 and 40 provide structural support for the upper surface 42 of the pad. For example, the ridges provide a relatively firm support for the pad when a foot steps on the pad.

The ridges 36, 38 and 40 also define multiple air chambers 44, e.g., more than a dozen, below the upper surface of the pad. The air chambers 44 provide flexibility to the upper surface 42 as the surfer steps on the pad. The air chambers deform under the pressure of a foot of the surfer. The ridges 36, 38 and 40 provide rigidity to the upper surface of the pad. The pattern of air chambers 44 and ridges 36, 38 40 may be designed to provide a desire flexibility and rigidity to the center ribs 16 and side ribs 20 on the upper surface of the pad. For example (and as shown in FIG. 5) a network of longitudinal and transverse ridges 38, 40 under the center ribs 16 provide firmness to the center ribs. In contrast, the solely longitudinal ridges 36 below the side grooves 20 allow the side ribs 19 to more easily flex when stepped upon. The pattern of ridges on the underside of the pad may be selected to provide the desired firmness to the pad. If a firm center rib(s) is desired, the ridges on the underside of the pad may be arranged in a pattern of longitudinal and transverse ridges and/or a pattern of ridges more densely arranged than the ridges under the side portions of the pad for which is desired a softer pad. Similarly, the network of ridges under the backstep 18 may be a dense network of closely spaced ridges to provide firmness to the protruding backstep.

The bottom surfaces of the ridges and ribs 36, 38 and 40, and of the border 32 are coated with the peal and stick adhesive. The adhesive may be coated with a peel-away release liner sheet that covers the entire underside of the pad. The release liner is removed immediately before application of the pad to the board. The board may be cleaned prior to application of the pad.

Figure 6:
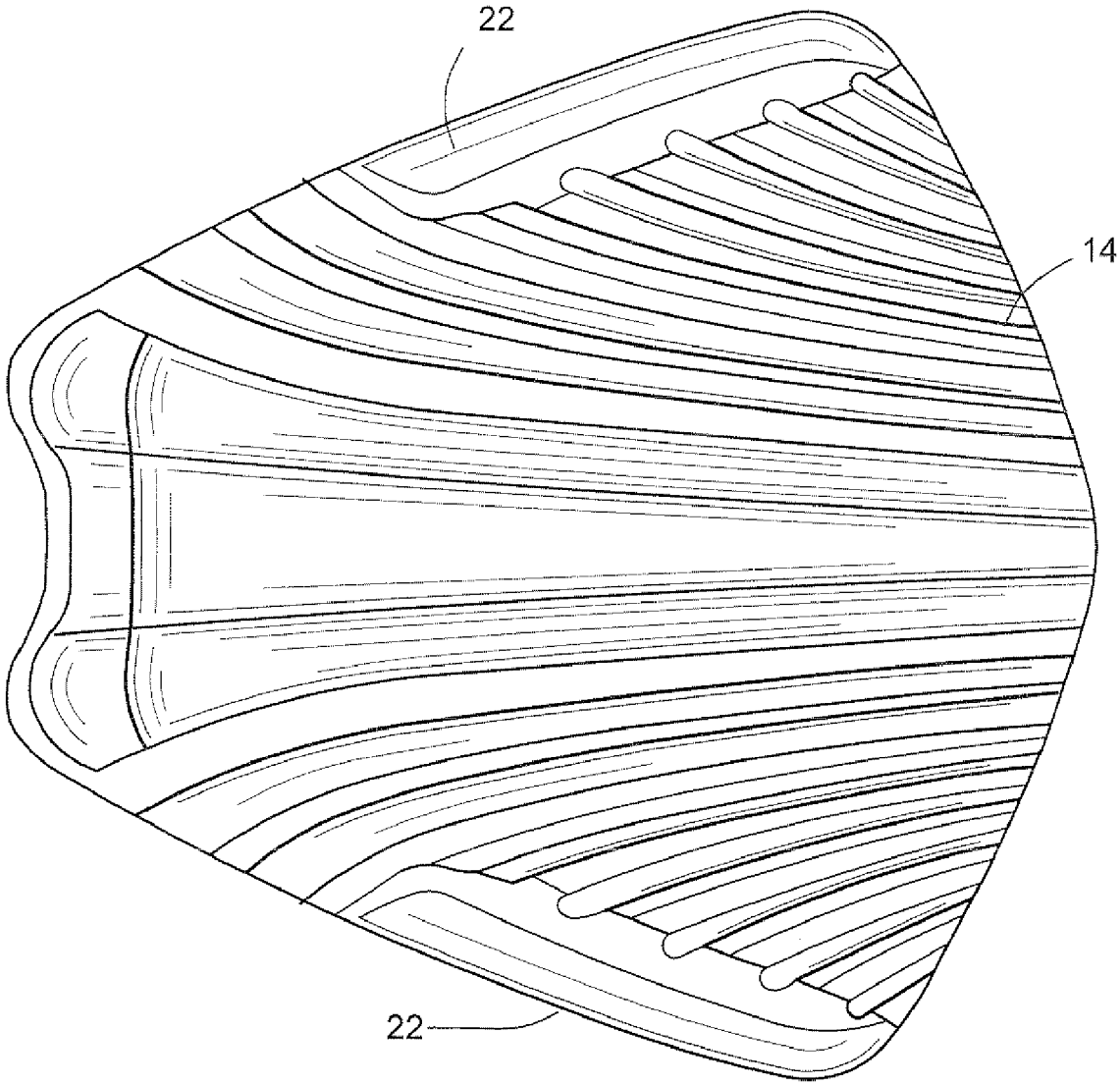
FIG. 6 is a top plan view of an alternative traction pad having side bars.

As shown in FIG. 6, the traction pad 14 may have side bars 22 which extend along a portion of the sides of the traction bars. The side bars can provide a brace and/or arch support for a foot of the rider. The side bars may extend approximately one-half to two-thirds of the length of the sides of the traction pads. The bars are relatively narrow and have a width of one to three inches. The height of the side bars may be one-half to two inches above the surface of the traction pad.

Figure 7:
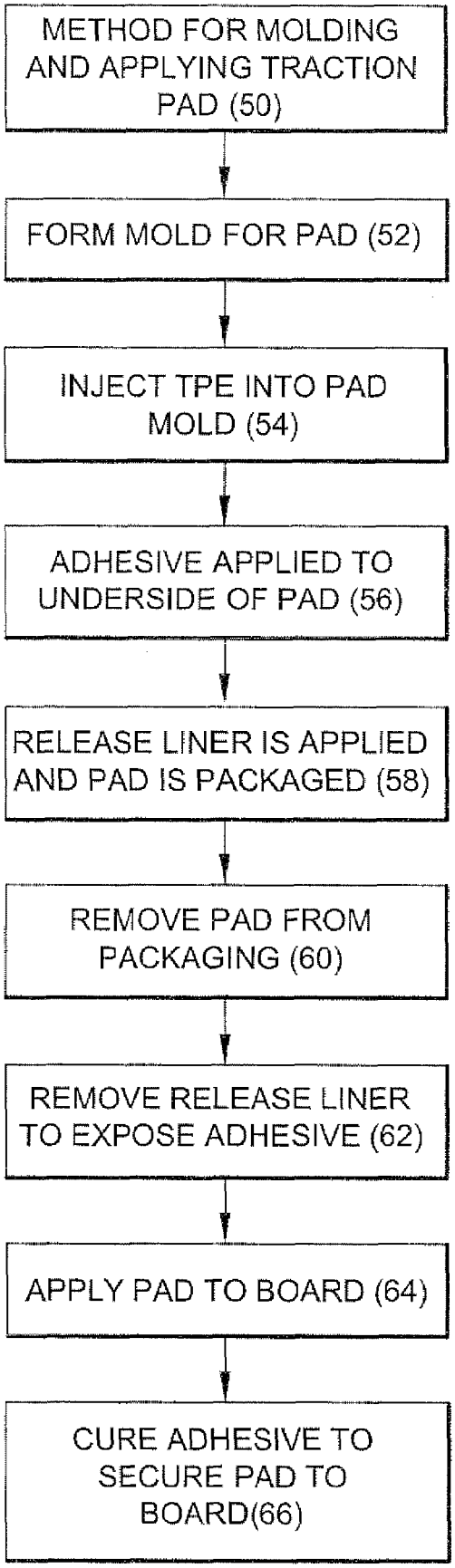
FIG. 7 is a flow chart of an injection molding and application method for the traction pad.

FIG. 7 is a flow chart of a method 50 for injection molding the traction pad and applying the pad to a board or other surface. In step 52, a mold is formed of the pad. The mold may be split with an upper mold half with an inside surface shaped as the desired upper pad surface and a lower mold half with an inside surface with the desired underside surface of the pad. The upper and lower mold halves are held together as thermo plastic elastomers (TPE) material is injected into the mold, in step 54. TPE is a relatively soft and deformable material. When stepped on, the TPE traction pad conforms to the foot to provide a good grip between the foot and board. TPE is generally impervious to water and does not become saturated with water during use of the board.

Injection molding allows for the use of a variety of thermo plastic elastomers into a variety of mold designs suitable for traction pads. The TPE materials can be clear, tinted, and solid colors, with a range of various durometers. The TPE material and molded surface patterns offers an excellent grip surface that does not irritate the skin of the surfer.

Injection molded traction pads can be formed using thermo plastic elastomer (TPE) materials. The TPE material may have various durometers, e.g., 28-A Soft, 40-A Medium, 60-A Firm, that allow the surfer a choice of traction firmness. Further, the pad may have a molded with a tire "tread" flow channels 19, 20 that allow water run off the traction surface. These molded surface designs create superior foot grip in the water. Thermo plastic materials and traction surface designs can be made that do not cause abrasion or rash to the skin of the surfer. Various molded designs that include rear foot block, raised center bar, foot slots, front foot, deck pads, saddle seat for a jet ski, foot pad for a boat deck and other such surfaces.

In step 56, an adhesive is applied to the underside surface of the pad. The adhesive may be applied to the molded pad flat border 32, the bottom of the ridges 36, 38 and 40, and/or other bottom surfaces of the pad. The adhesive may be applied as a sheet that covers the entire underside surface of the pad, or applied only to the border, 32 and bottoms of ridges and ribs 36, 38 and 40. Applying the adhesive only to the border and ridge bottoms allows the air chambers 44 to be formed between the underside of the pad and upper surface of the board. In step 58, a release liner is applied to the adhesive and the pad is packaged for shipment.

In step 60, the pad is removed by a user and positioned near or on the board. The board should be cleaned so that the upper board surface provides a good surface to receive the adhesive and pad. A primer coating may be applied to the board to provide a good sticking surface for the adhesive. By removing the release liner, the adhesive on the underside of the pad is exposed in step 62. The pad is positioned on the board, such as on the upper board surface, near the rear of the board and aligned with a longitudinal axis of the board, in step 64. The adhesive cures and secures the pad to the board in step 66.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A traction surface for a water board comprising:

a traction pad formed of a molded thermo plastic elastomer (TPE) material, and an upper surface of the pad having a roughened texture, wherein the traction surface includes at least one rib extending substantially parallel to a centerline of the board, and a pattern of interlaced ribs and grooves adjacent the at least one rib and fanning out from a front edge of the surface to side surfaces of the surface.

2. A traction surface for a water board comprising:

a traction pad formed of a molded thermo plastic elastomer (TPE) material;

an upper surface of the pad having a roughened texture, and an underside of the pad having a pattern of ridges, wherein the pattern is more dense below the at least one rib than below a pattern of interlaced ribs and grooves.

3. A traction pad for a water board comprising:

an upper surface of the pad having a roughened texture, an underside of the pad including ridges and chambers between the ridges, wherein the chambers have an open side to be closed by a surface of the water board, wherein the traction pad is formed of a molded thermo plastic elastomer (TPE) material.

4. The traction pad of claim 3 wherein the traction pad further comprises an adhesive on the underside of the pad and a release liner on the adhesive.

5. The traction pad of claim 3 wherein the upper surface includes a center ridge extending a length of the pad and substantially parallel to a centerline of the board.

6. The traction pad of claim 3 wherein the upper surface includes a back step at a rear of the pad.

7. The traction pad of claim 3 wherein the traction surface includes a plurality of interlaced ribs and grooves extending substantially parallel to a centerline of the board.

8. The traction pad of claim 3 wherein the upper surface of the pad includes at least one centerline rib extending substantially parallel to a centerline of the board, and a pattern of interlaced ribs and grooves adjacent the at least one rib and fanning out from a front edge of the surface to side surfaces of the surface.

9. The traction pad of claim 8 wherein the ridges includes longitudinal and transverse ridges below the at least one centerline rib and solely longitudinal ridges below the pattern of interlaced ribs and grooves.

10. The traction pad of claim 3 wherein the pad is formed by injection molding.

11. A method to make and apply a traction pad to a water board comprising:

injection molding a thermo plastic elastomer (TPE) material to form an upper surface of the pad having a roughened texture and an underside including ridges and chambers between the ridges an upper surface of the pad having a roughened texture;

applying an adhesive material to the underside of the pad and coating the adhesive with a release liner;

preparing the board to receive the pad by cleaning the board;

removing the release liner from the pad to expose the adhesive, and applying the exposed adhesive and pad to the board.

12. The method of claim 11 wherein the pad is applied to be aligned with a longitudinal centerline of the board.

13. The method of claim 11 wherein the adhesive material is applied to a flat border on the underside of the pad and to the ridges on the underside of the pad.

14. The method of claim 11 wherein the pad is transparent or translucent and the pad is applied to the board to allow viewing of patterns on the board below the pad.

15. A traction pad to be applied to a surface, the pad comprising:

an upper surface of the pad adapted to receive a body part of a human;

an underside of the pad including ridges and chambers between the ridges, wherein the chambers have an open side to be closed by the surface to which the pad is applied;

an adhesive on the underside of the pad, and a release liner on the adhesive, wherein the traction pad is formed of a molded thermo plastic elastomer (TPE) material.

16. A traction pad to be applied to a surface, the pad comprising:

an upper surface of the pad adapted to receive a body part of a human, wherein the upper surface of the pad includes a center ridge extending a length of the pad;

an underside of the pad including ridges and chambers between the ridges, wherein the chambers have an open side to be closed by the surface to which the pad is applied, and wherein the traction pad is formed of a molded thermo plastic elastomer (TPE) material.

17. A traction pad to be applied to a surface, the pad comprising:

an upper surface of the pad adapted to receive a body part of a human, wherein the upper surface of the pad includes a back step at a rear of the pad;

an underside of the pad including ridges and chambers between the ridges, wherein the chambers have an open side to be closed by the surface to which the pad is applied, and wherein the traction pad is formed of a molded thermo plastic elastomer (TPE) material.

18. A traction pad to be applied to a surface, the pad comprising:

an upper surface of the pad adapted to receive a body part of human, wherein the upper surface of the pad includes a plurality of interlaced ribs and grooves;

an underside of the pad including ridges and chambers between the ridges, wherein the chambers have an open side to be closed by the surface to which the pad is applied, and wherein the traction pad is formed of a molded thermo plastic elastomer (TPE) material.

19. A traction pad to be applied to a surface, the pad comprising:

an upper surface of the pad adapted to receive a body part of human, wherein the upper surface of the pad includes at least one centerline rib, and a pattern of interlaced ribs and grooves adjacent the at least one centerline rib and fanning out from a front edge of the surface to side surfaces of the pad;

an underside of the pad including ridges and chambers between the ridges, wherein the chambers have an open side to be closed by the surface to which the pad is applied, and wherein the traction pad is formed of a molded thermo plastic elastomer (TPE) material.

20. The traction pad of claim 19 wherein the ridges includes longitudinal and transverse ridges below the at least one centerline rib and solely longitudinal ridges below the pattern of interlaced ribs and grooves.

21. A method to make and apply a traction pad to a surface, the method comprising:

injection molding a thermo plastic elastomer (TPE) material to form an upper surface of the pad having a roughened texture adapted to receive a body part of a human, and an underside of the pad including ridges and chambers between the ridges an upper surface of the pad having a roughened texture;

applying an adhesive material to the underside of the pad and coating the adhesive with a release liner;

preparing the surface to receive the pad by cleaning the surface;

removing the release liner from the pad to expose the adhesive, and applying the exposed adhesive and pad to the surface.

22. The method of claim 21 wherein the pad is applied to be aligned with a longitudinal centerline of the surface.

23. The method of claim 21 wherein the adhesive material is applied to a flat border on the underside of the pad and to the ridges on the underside of the pad.

24. The method of claim 21 wherein the pad is transparent or translucent and the pad is applied to the surface to allow viewing of patterns on the board below the surface.

* * * * *